US006405982B2

(12) United States Patent
Ferencz

(10) Patent No.: US 6,405,982 B2
(45) **Date of Patent: *Jun. 18, 2002**

(54) SELF-ATTACHING SLIDING SUPPORT FOR ARTICLES OF FURNITURE

(75) Inventor: Madi Ferencz, Larchmont, NY (US)

(73) Assignee: Magic Sliders, LP, White Plains, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,112

(22) Filed: Dec. 18, 1998

(51) Int. Cl.[7] ..... A47B 91/00; F16M 11/20

(52) U.S. Cl. ..... 248/188.9; 248/346.11; 248/364.04; 16/42 R

(58) Field of Search ..... 248/188.8, 188.9, 248/346.03, 615, 688, 677, 346.11, 346.04; 16/42 R

(56) References Cited

U.S. PATENT DOCUMENTS

| | | | | | |
|---|---|---|---|---|---|
| 1,603,876 | A | | 10/1926 | Shapard | 16/42 R |
| 1,861,095 | A | * | 5/1932 | Schacht | 248/346.11 |
| 1,903,609 | A | * | 4/1933 | Uhl | 16/42 R |
| 1,915,272 | A | | 6/1933 | Duncan | 248/188.9 |
| 1,982,138 | A | | 11/1934 | Herold | 248/346.11 |
| 2,030,649 | A | * | 3/1936 | Miller | 16/42 R |
| 2,644,978 | A | | 7/1953 | Becker | 16/42 R |
| 2,710,027 | A | | 7/1955 | Husgen et al. | 138/89 |
| 2,840,113 | A | | 6/1958 | Simpson et al. | 138/89 |
| 2,865,133 | A | * | 12/1958 | Hoven | 248/188.9 |
| 2,875,552 | A | | 3/1959 | Stillman | 248/188.9 |
| 2,878,509 | A | | 3/1959 | Fisher | 16/42 R |
| 2,902,794 | A | | 9/1959 | Ehrgott | 248/794 |
| 2,968,116 | A | * | 1/1961 | Arenson | 248/188.9 |
| 3,078,498 | A | * | 2/1963 | Morgan | 16/42 R |
| 3,177,518 | A | | 4/1965 | Bergstrom | 16/42 R |
| 3,183,545 | A | | 5/1965 | Bergstrom | 16/42 R |
| 3,389,421 | A | * | 6/1968 | Wheeler | 16/42 R |
| 3,505,724 | A | * | 4/1970 | Leitner et al. | 16/42 R |
| 3,640,496 | A | | 2/1972 | Duncan | 248/188.9 |
| 3,845,924 | A | * | 11/1974 | Taviere et al. | 248/615 |
| 4,327,460 | A | | 5/1982 | Wolff | 16/18 A |
| 5,081,740 | A | | 1/1992 | Smith | 16/42 R |
| 5,094,416 | A | * | 3/1992 | Huon | 248/188.8 |
| 5,220,705 | A | | 6/1993 | Bushey | 16/42 R |
| 5,426,818 | A | | 6/1995 | Bushey | 16/42 R |
| 5,469,599 | A | * | 11/1995 | Wurdack | 16/42 R |
| 5,680,673 | A | | 10/1997 | Beshore | 16/42 R |
| 5,782,444 | A | * | 7/1998 | Anderman et al. | 248/188.8 |
| 5,802,669 | A | * | 9/1998 | Wurdack | 16/42 R |
| 6,088,877 | A | | 7/2000 | Swy et al. | 16/42 T |
| 6,154,923 | A | | 12/2000 | Carpinella | 16/42 R |

* cited by examiner

*Primary Examiner*—Anita King
*Assistant Examiner*—Gwendolyn Baxter
(74) *Attorney, Agent, or Firm*—Lieberman & Nowak, LLP

(57) ABSTRACT

A sliding support for a legged article, such as an article of furniture, that can be attached to the article without the need for a separate fastener. The support will not become dislodged if the article of furniture is moved, can be reused many times, and will not damage the legs of the furniture. The support includes a resilient element for gripping the legs of an article of furniture and a slidable element for contact with the floor. The interengagement of the two elements assures that the support will not become dislodged as the article is moved.

13 Claims, 1 Drawing Sheet

SELF-ATTACHING SLIDING SUPPORT FOR ARTICLES OF FURNITURE

BACKGROUND OF THE INVENTION

This application is directed to a device for supporting the legs of an article, such as an article of furniture, for sliding support along a surface such as a floor. More particularly, this application is directed to a support device which will permit the article to be readily slid along a surface, which does not require separate fastener to attach the device to the article of furniture, and which can readily accommodate a range of leg sizes.

Over the years many devices have been proposed for supporting various legged articles, such as articles of furniture, over a floor so that the article of furniture will not damage the floor or prevent the furniture from being slidably displaced. Other similar devices seek to prevent the article of furniture from being easily moved. Such devices are shown in British Patent No. 4,073; as well as U.S. Pat. Nos. 1,861,095; 1,903,690; 1,969,266; 3,326,508; 5,094,416 and 5,573,212. Many of the prior art devices simply rest on the floor and are not attached to the legs of the article of furniture, and rely on the gravity to position the legs on the supporting device. Other prior art devices are physically attached to the legs of the article of furniture by separate fasteners such as screws, nails, posts or an adhesive pad.

A problem with the first category of furniture support devices, in which the article of furniture merely rests on the support, is that the support can easily become disengaged from the legs of the furniture if for example, the article of furniture is slightly lifted. A shortcoming of the second category of devices, which utilize an separate fastening device, such as a screw or nail, is that the fastener can easily become lost and can damage the furniture leg, or can only be used once, such as when an adhesive pad is used as a fastener. Furthermore, many devices of both types can accommodate only legs of exact sizes requiring retailers to carry many different sizes of supports. The present invention is directed to overcoming the deficiencies of the prior art.

The present invention is directed to a sliding support device for a legged article, such as an article of furniture, that can be attached to the article without the need for an separate fastener, and which can accommodate a range of leg sizes. The inventive support device will not become dislodged if the article of furniture is moved, can be reused many times, and will not damage the legs of the furniture.

BRIEF DESCRIPTION OF THE DRAWINGS

For a better understanding of the invention, reference is made to the following drawings which are to be taken in conjunction with the detailed description to follow.

DETAILED DESCRIPTION OF THE DRAWINGS

Figure 1:
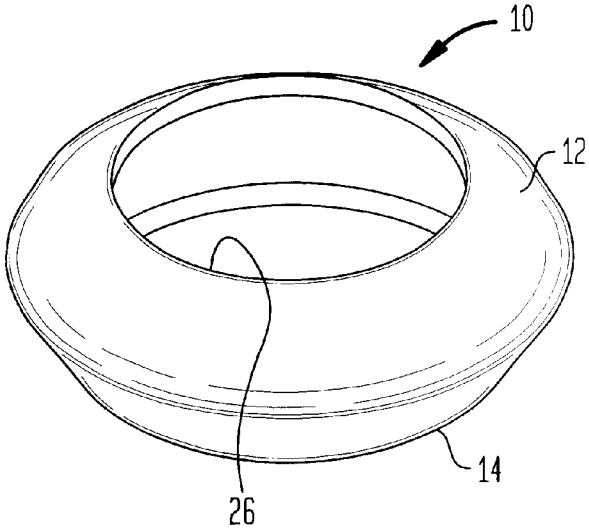
FIG. 1 is a perspective view of the self-attaching sliding support constructed in accordance with the present invention.
Figure 2:
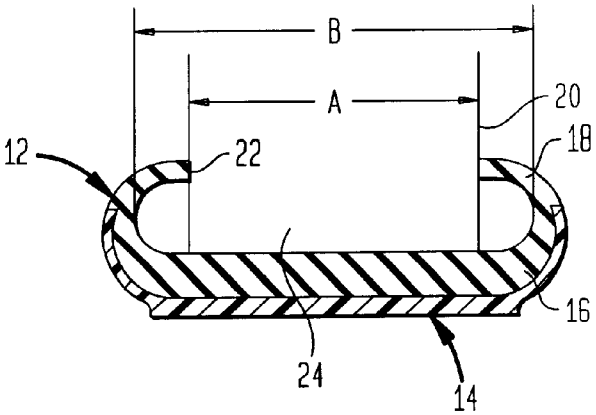
FIG. 2 is a view of the self-attaching sliding support for an article of furniture in accordance with the present invention.

FIGS. 1 and 2 are perspective and sectional views of a self-attaching slidable support 10 for an article of furniture. Support 10 includes a first elastomeric element 12 and a second sliding element 14. Elastomeric element 12 includes a relatively thick base portion 16 which will serve to cushion the weight of the article to be supported. Molded integrally with base portion 16 of elastomeric element 12 is an upstanding concave inwardly extending circumferential rim 18. Rim 18 is generally "C" shaped and serves to engage a leg 20 of the article of furniture to be supported. As rim 18 is formed from elastomeric material, it is free to elastically engage the perimeter of leg 20. Furthermore, rim 18 is also capable of accommodating legs of a range of sizes and shapes.

As is seen in FIG. 2, the edge 22 of rim 18 extends inwardly and overhangs the interior space 24 of elastomeric element 12. The diameter of the circular opening 26 of rim 18 is shown in FIG. 2 as dimension A. However, the diameter of interior space 24 of element 12 is shown as dimension B which is larger than that of dimension A. As rim 18 will elastically deform when leg 20 is inserted therein, support 10 can thus accommodate furniture legs in the diameter range of A to B. Furthermore, rim 18 will also accommodate square or rectangular legs whose diagonal is within the range A to B. This reduces the number of sizes of supports 10 that a retailer needs to carry in stock. In addition, the generally circular support 10 shown herein could also be oval or rectangular in plan view.

Figure 3:
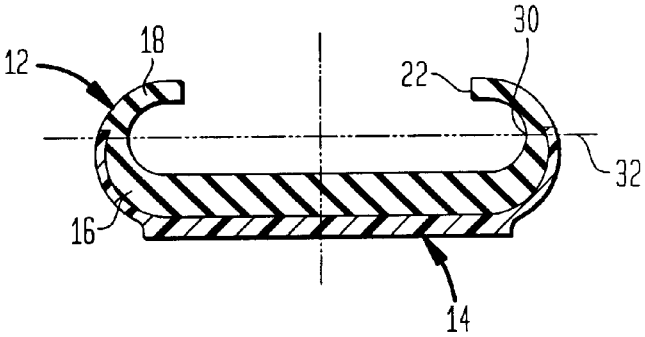
FIG. 3 is an enlarged sectional view of the interengagement of the elastomeric and sliding elements of the device.

Sliding portion 14 is generally cup shaped and is joined to the underside of elastomeric portion 12 so that it will rest on the surface on which the article of furniture is to be supported. Sliding portion 14 is preferably fabricated from a hard relatively low friction plastic such as polytetraflouroethylene (PTFE/Teflon) or Ultra High Molecular Weight Polyethylene (UHMWPE). Alternatively, many other relatively hard plastics or metals could also be used for sliding portion 14. FIG. 3 is an enlarged sectional view of the interengagement of elements 12 and 14 at the periphery of support 10. The outer edge of elastomeric element 12 includes a flange 30 which extends outwardly and is disposed along the horizontal center line 32 of support 10. The width of flange 30 is approximately equal to the thickness of the material used to form sliding element 14. The rigid material of sliding element 14 will support elastomeric element 12 and form a "bumper" should support 10 hit another object. This arrangement also ensures that any turning moments created as the furniture is moved along the floor will not cause forces tending to separate elements 12 and 14 and also that support 10 will not become disengaged from leg 20. Further assuring the retention of support 10 on leg 20 is the fact the rim portion 18 of elastomeric element 12 tapers in thickness from a widest portion located at flange 30 to a narrowest portion at its edge 22. This ensures that elastomeric element 12 will be biased toward leg 20 and will freely flex to accommodate a range of leg sizes.

Suitable materials for elastomeric element 12 are flexible plastics or rubbers such as Nitrile rubber which is readily moldable. The use of a elastomeric element 12 leads to an efficient manufacturing process which bonds elastomeric element 12 and sliding element 14 together. In this process, sliding element 14 is first formed and is placed in the cavity of the mold for elastomeric element 12, which is then molded and vulcanized with element 14 in the mold. This will securely bond elements 12 and 14 together, and will provide the appearance of a smooth continuous outer surface to support 10. This manufacturing methodology assures the formation of flange 30.

The present invention has been described with respect to particular embodiments which should not be construed to exclude application of the present invention under other circumstances which employ the device to a more limited degree or with altered dimensions. It will be readily apparent to one of ordinary skill in the art that the present invention has many other applications consistent with its design.

What is claimed is:

1. A slidable support for an article comprising:

an elastomeric element for elastic engagement with a leg of an article to be supported, said elastomeric element having a base portion, a circumferential inwardly extending rim and a horizontally disposed flange located at a outer periphery of said elastomeric element, said rim having an edge which extends horizontally inward and overhangs an interior space formed by the rim, so that the elastomeric element is able to releasably grip legs ranging in size from the relaxed diameter of the interior space to a stretched diameter of said space, said stretched diameter being bigger than the relaxed diameter; and a sliding element constructed of low-friction material, said sliding element molded to the lower portion of the elastomeric element for contact with a surface upon which the article is to be supported, said sliding element engaging the flange of said elastomeric element so as to provide support for the rim of the elastomeric element.

2. A slidable support for an article according to claim 1, wherein the elastomeric element is constructed essentially of Nitrile rubber.

3. A slidable support for an article according to claim 1, wherein the circumferential rim is generally "C" shaped and is tapered from a widest portion at the flange, to a narrowest point towards the center of the elastomeric element.

4. A slidable support for an article according to claim 1, wherein the low friction material is selected from the group consisting of polytetraflouroethylene and ultra high molecular weight polyethylene.

5. A slidable support for an article according to claim 1 wherein the elastomeric element is integrally joined with the slidable element.

6. A slidable support for an article comprising:

an elastomeric element for elastic engagement with a leg of an article to be supported, said elastomeric element having a base portion, a circumferential inwardly extending rim and a horizontally disposed flange located at a outer periphery of said elastomeric element, said rim having an edge which extends horizontally inward and overhangs an interior space formed by the rim, so that the elastomeric element is able to releasably grip legs ranging in size from the relaxed diameter of the interior space to a stretched diameter of said space, said stretched diameter being bigger than the relaxed diameter; and a sliding element constructed of a low friction material selected from the group consisting of polytetraflouroethylene and ultra high molecular weight polyethylene, said sliding element molded to the lower portion of the elastomeric element for contact with a surface upon which the article is to be supported, said sliding element having a thickness substantially equal to the rim of the elastomeric element and having upwardly extending rounded sides extending around the lower portion of the elastomeric element and engaging the flange of the elastomeric element such that the slidable support remains slidable when the leg of the article is at an angle other than perpendicular to the surface.

7. A slidable support for an article according to claim 6, wherein the elastomeric element is constructed essentially of Nitrile rubber.

8. A slidable support for an article according to claim 6, wherein the circumferential rim is generally "C" shaped and is tapered from a widest portion at the flange, to a narrowest point towards the center of the elastomeric element.

9. A slidable support for an article according to claim 6, wherein the elastomeric element is integrally joined with the slidable element.

10. A slidable support for an article comprising:

an elastomeric element for elastic engagement with a leg of an article to be supported, said elastomeric element having a base portion, a circumferential inwardly extending rim and a horizontally disposed flange located at a outer periphery of said elastomeric element, said rim having an edge which extends horizontally inward and overhangs an interior space formed by the rim, so that the elastomeric element is able to releasably grip legs ranging in size from the relaxed diameter of the interior space to a stretched diameter of said space, said stretched diameter being at least one and a half times larger than the relaxed diameter; and a sliding element constructed of a low friction material selected from the group consisting of polytetraflouroethylene and ultra high molecular weight polyethylene, said sliding element molded to the lower portion of the elastomeric element for contact with a surface upon which the article is to be supported, said sliding element having a thickness substantially equal to the rim of the elastomeric element and having upwardly extending rounded sides extending around the lower portion of the elastomeric element and engaging the flange of the elastomeric element such that the slidable support remains slidable when the leg of the article is at an angle other than perpendicular to the surface.

11. A slidable support for an article according to claim 10, wherein the elastomeric element is constructed essentially of Nitrile rubber.

12. A slidable support for an article according to claim 10, wherein the circumferential rim is generally "C" shaped and is tapered from a widest portion at the flange, to a narrowest point towards the center of the elastomeric element.

13. A slidable support for an article according to claim 10, wherein the elastomeric element is integrally joined with the slidable element.

* * * * *